US005181488A

United States Patent [19]

Sakurai

[11] Patent Number: 5,181,488

[45] Date of Patent: Jan. 26, 1993

[54] TWO DIFFERENT FUEL FEEDER

[75] Inventor: Yoshihiro Sakurai, Hamamatsu, Japan

[73] Assignee: Sanshin Kogyo Kabushiki Kaisha, Hamamatsu, Japan

[21] Appl. No.: 593,780

[22] Filed: Oct. 5, 1990

[30] Foreign Application Priority Data

Oct. 5, 1989 [JP] Japan ..... 1-258912

[51] Int. Cl.[5] ..... F02M 1/16

[52] U.S. Cl. ..... 123/179.11; 123/576

[58] Field of Search ..... 123/180 R, 187.5 R, 123/180 P, 576, 195 P, 179 G, 179.11, 179.9

[56] References Cited

U.S. PATENT DOCUMENTS 2,569,346 9/1951 Shively ..... 123/195 P
3,948,589 4/1976 DuBois ..... 123/187.5 R
4,375,206 3/1983 Baltz et al. ..... 123/187.5 R
4,401,094 8/1983 Shimmura et al. ..... 123/576
4,441,467 4/1984 Powell ..... 123/180 R
4,542,723 9/1985 Fujimoto ..... 123/187.5 R

*Primary Examiner*—Andrew M. Dolinar
*Attorney, Agent, or Firm*—Ernest A. Beutler

[57] ABSTRACT

A fuel supply system for an outboard motor having a main fuel supply for supplying fuel to the engine and an enrichment fuel supply for supplying a different fuel for starting and cold running. The enrichment fuel supply supplies fuel to the engine through a common enrichment control housing assembly that includes an enrichment pump and an enrichment fuel flow control which are both operated simultaneously. In addition, the enrichment fuel source has a vent system including a vent valve that is operated simultaneously with the enrichment fuel valve and the enrichment pump.

3 Claims, 6 Drawing Sheets

TWO DIFFERENT FUEL FEEDER

BACKGROUND OF THE INVENTION

This invention relates to a device for supplying a more volatile fuel to an internal combustion engine in addition to its main, usually less volatile fuel supply.

It is well known to supply enrichment fuel to an internal combustion engine under certain conditions. For example, enrichment fuel may be provided so as to assist in starting and/or for cold running warmup. Generally the enrichment fuel is supplied to the engine only during cold startup, and the supply of enrichment fuel is discontinued only after sufficient warming of the engine has occurred.

Although systems have been available for supplying enrichment fuel, the procedures involving their use are typically burdensome. On startup, the enrichment fuel is made available to and usually primed into the engine, frequently means are provided to continue the supply of enrichment fuel during warming, and finally a procedure for terminating the use of the enrichment fuel after warming is usually necessary.

The problems associated with cold starting are particularly troublesome in the case of the two cycle engine which may be operated with a lower quality of fuel such as alcohol or kerosene, which have a lower volatility than gasoline. There are advantages to operating with a lower volatility fuel, including lower cost. Often, lack of availability of higher volatility fuels necessitates the use of lower volatility fuels such as kerosene.

Some engines have separate valves and a priming pump with a stepwise procedure for operating each one. Further, once the engine is running and while the boat is moving, it may be difficult to perform procedures to shut off the enrichment fuel.

In addition, when a supply of enrichment fuel is present, the tank from which it is withdrawn needs to be vented to displace the withdrawn enrichment fuel with air. Venting the tank open could cause spills if the tank is filled. A separate vent valve would entail another operating step in the startup and the shut-down procedure.

In two cycle engines the main fuel supply typically finds its way to the combustion chamber through the crankcase and then through scavenging ports on the sides of the cylinder walls. On cold startup, the fuel supplied in this way to the engine may significantly condense in the crankcase preventing its effectively reaching the combustion chamber. This is particularly true during the times of low fuel flow, as when the engine is idling and when using low quality low volatility fuels.

Systems which provide to an engine the fuel needed for operation are typically referred to as charge forming devices. In the two-cycle engine, provision may be made for an idling circuit which involves the application a small amount of the main fuel directly to a point near the main combustion chamber of the engine rather than through the crankcase during idling. Any enrichment fuel system should be formed integral with and become a cooperative member of the engine's charge forming device.

Some systems have incorporated pumping devices into the charge forming system of an engine for supplying only a finite amount of enrichment fuel. These pumping devices are generally "one shot" types of devices that only provide an initial squirt of enrichment fuel before starting, and then no more. Other systems merely make a supply of enrichment fuel available, in which case the user may be able to marshal an adequate supply of enrichment fuel in the combustion chamber only after several successive cranking operations. Neither of these devices are satisfactory.

The provision of an enrichment fuel supply device in an engine charging system involving minimum steps for its operation, and which would provide the advantages of both a flowing supply and "one shot" priming would yield new and significant advantages over the prior art.

SUMMARY OF THE INVENTION

This invention is adapted to be embodied in a charge forming device for an engine with or without an idler circuit, and supplies an initial primed amount of enrichment fuel in addition to a continuing flow of enrichment fuel to facilitate warming. Means are provided for selectively supplying enrichment fuel, priming the flow of enrichment fuel and venting the enrichment fuel supply tank simultaneously with a single action. Likewise, a single step reverses enrichment fuel availability by, shutting off the enrichment fuel valve, and shutting off the enrichment fuel tank vent valve. The single action operation is facilitated by housing components of the enrichment fuel system in a central housing.

DETAILED DESCRIPTION OF THE PREFERRED EMBODIMENT

The enrichment fuel system of the two fuel feeder of the present invention is described in conjunction with an outboard motor having a main fuel operational system, a main fuel idling circuit and an enrichment fuel system which is utilizable during startup, warmup, or running. After a discussion of the outboard engine environment, the three fuel systems will be described.

Figure 1:
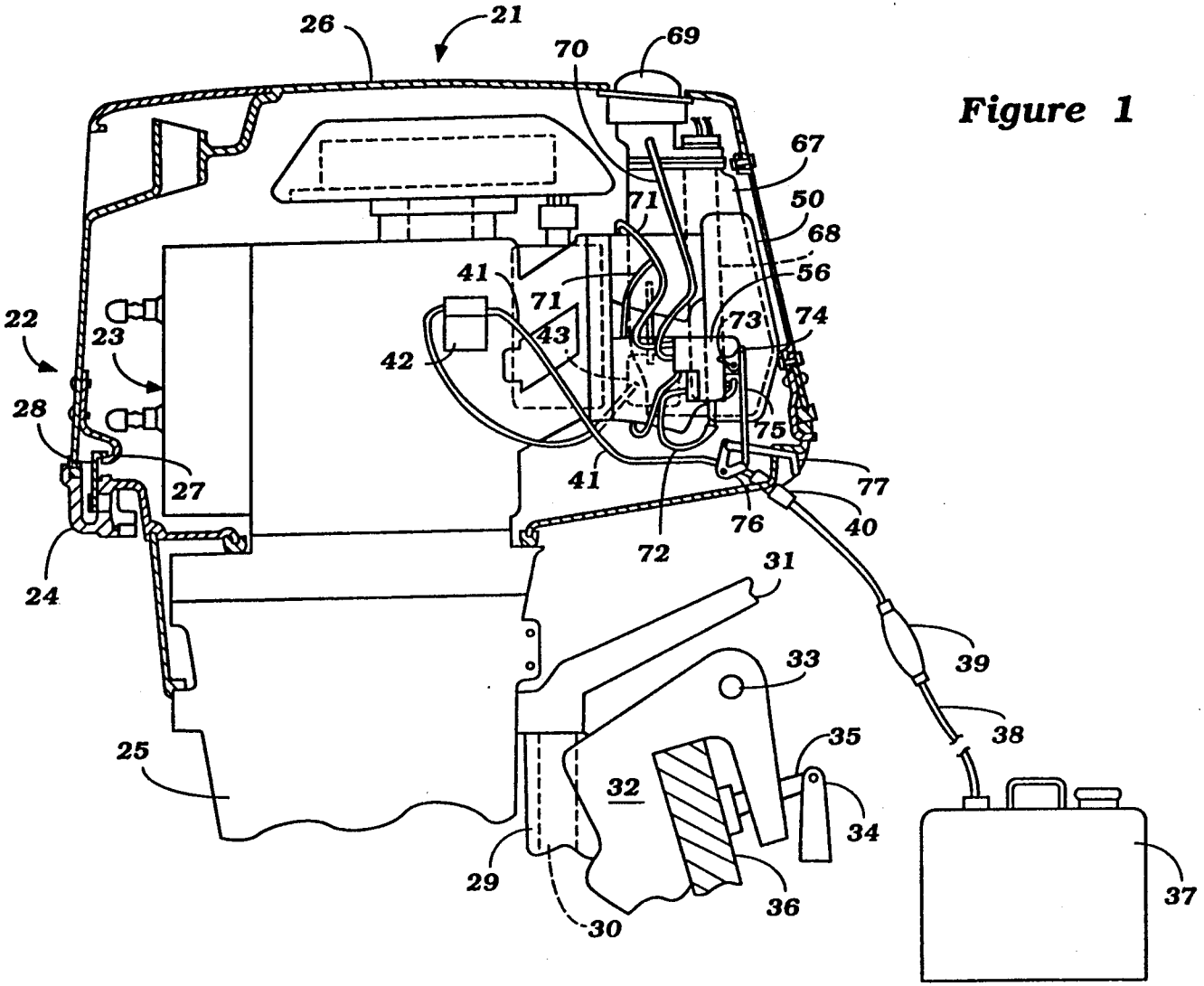
FIG. 1 is a side elevational view of an outboard motor attached to the transom of a watercraft constructed in accordance with an embodiment of the invention, with a portion broken away.

Referring first to FIG. 1, an outboard motor constructed in accordance with an embodiment of the invention is identified generally by the reference numeral 21. The invention is described in conjuction with an outboard motor because such outboard motors are typical examples of environments in which the invention may be utilized. It is to be understood, however, that the invention can be utilized in conjunction with other applications for internal combustion engines.

Outboard motor 21 is comprised of a power head, indicated generally by the reference numberal 22, and includes an internal combustion engine 23 constructed in accordance with an embodiment of the invention. Inasmuch as the invention relates to the engine 23, the outboard motor 21 has not been shown completely. The power head 22 further includes an outer or protective housing including a tray part 24 that is supported on the upper end of a drive shaft housing 25 in a known manner. A main cover portion 26 is detachably connected to tray part 24 by means of a hook 27 and releasable latch mechanism 28.

The engine 23 has a crankshaft (not shown) rotatable about a vertically extending axis and which is coupled to a drive shaft (similarly not shown) that is journaled in the drive shaft housing 25. This drive a propulsion unit that is contained within the lower unit, the components of which are not shown for the aforenoted reason.

A swivel bracket 29 journals a steering shaft 30. The steering shaft 30 is connected to the drive shaft housing in a known manner for steering of the outboard motor 21 and its associated watercraft. A steering tiller 31 is affixed to the steering shaft for this purpose. The swivel bracket 29 is pivotally connected to a clamp bracket 32 by means of a horizontally disposed tilt pin 33 for tilt and trim movement of the outboard motor 21 in a known manner. A clamp 34, having a threaded member 35 is connected to the clamp bracket 33, and detachably affixes the outboard motor 21 to a transom 36 of the associated watercraft.

Figure 2:
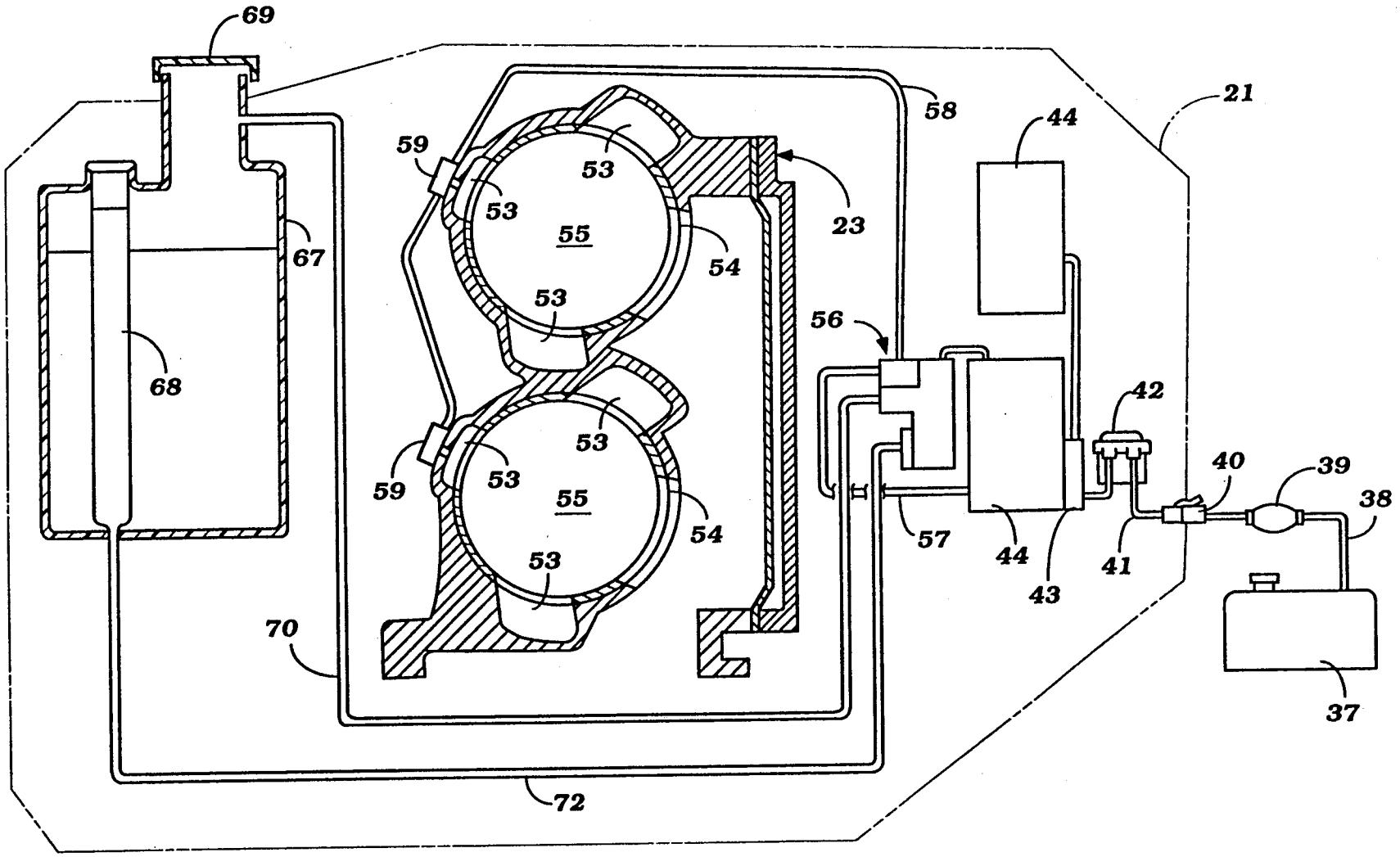
FIG. 2 is a schematic of the enrichment fuel system illustrating the outboard motor boundary in broken line format, and a cross section of the power head of the outboard motor of FIG. 1.

The main fuel system of outboard motor 21 includes components both internally and externally with respect to power head 22, and is illustrated in both FIGS. 1 and 2. The main fuel system generally consists of a main fuel tank 37 positioned within a water craft hull and having an external fuel line 38. A manually operated primer pump 39, is used to prime the main fuel into outboard motor 21. External fuel line 38 terminates in a quick connect fitting 40 held in place within the tray part 24.

The main fuel path continues within power head 22 from fitting 40 through an internal fuel line 41. Internal fuel line 41 continues through a filter 42 and terminates in a main fuel pump 43 which is operated in a suitable manner by the engine 23. Main fuel pump 43 supplies fuel through a pair of carburetors 44 in the event the engine 23 has two cylinders as illustrated. Returning to FIG. 3, a detail of one of the carburetors 44 of FIG. 2 is illustrated. A main fuel line 45 from fuel pump 43 is attached to a fuel bowl and float ring assembly 46. Main fuel feed nozzle 47 is fed by fuel bowl and float ring assembly 46. Main fuel feed nozzle 47 lies between a throttle valve 48 and a choke valve 49. Upstream of choke valve 49 is located the silencer 50 shown in FIG. 1. Downstream of throttle valve 48 is an intake manifold 51 having a reed-type check valve 52. Check valve 52 prevents blow back of fuel during the power stroke of the associated piston served by carburetor 44. The intake manifold 51 then discharges into the crankcase (not shown) of engine 23. The main fuel during normal operations typically makes its way from the crankcase into the combustion chambers through scavenging ports 53 in cylinder walls 54 which surround pistons 55.

Also shown in FIG. 2, and fueled by the main fuel supply, is the idle circuit, which is formed in a combined valve, priming pump and idle circuit assembly 56. A line 57 extends from main fuel pump 43 to the assembly 56. Among other things, assembly 56 supplies a fuel air emulsion formed from the main fuel into a line 58 extending to a pair of injection nozzles 59 positioned directly in the scavenge passages serving at least one of the scavenge ports 53.

Figure 8:
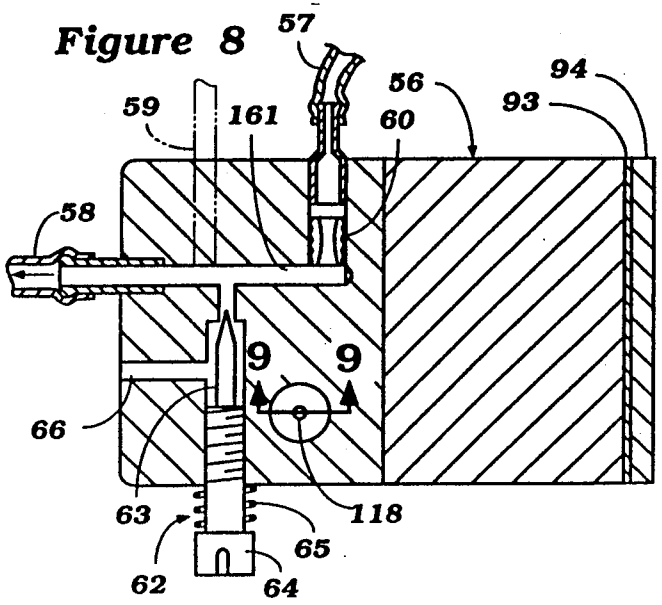
FIG. 8 is a cross sectional view taken along the line 8—8 of FIG. 4.

The fuel air emulsion is formed, referring to the details of FIG. 8 of a needle valve and jet detail seen therein. Line 57 feeds a jet 60. Jet 60 opens into a passage 61 which is in communication with passage 58, previously shown in FIG. 2 as part of the idle circuit. Passage 61 is also in communication with a needle valve, generally designated by the number 62, and having a needle portion 63 mounted onto the end of a needle valve screw 64 opposed by a needle valve spring 65. To the side of needle 63 is an air inlet 66.

The enrichment fuel system is best seen beginning with FIGS. 1 and 2. An enrichment fuel tank 67 is shown having a filter 68 and a filler cap 69. Tank 67 is positioned adjacent the air silencer 50 that supplies air to the carburetor 44, and adjacent assembly 56. A vent line 70 extends from a point below filler cap 69 and into assembly 56. A pair of enrichment fuel lines 71 extend in a "Y" configuration from assembly 56 to carburetors 44. A line 72 extends from filter 68 to deliver auxiliary fuel to the assembly 56. As shown in FIG. 1, the assembly 56 includes a valve shaft 73 connected externally to a lever 74. Lever 74 is operable connected through a link 75 to a link 76, which is in turn connected to a lever 77 which extends outside of the boundary of tray part 24 for manual operation.

Figure 4:
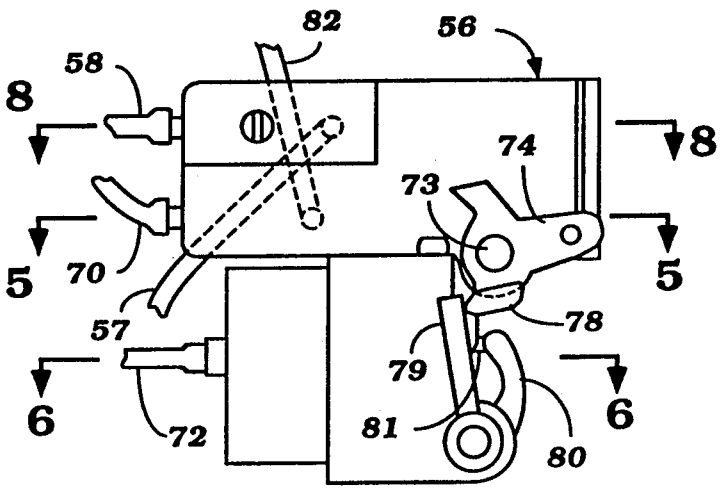
FIG. 4 is an elevational view of the enrichment fuel actuating assembly of the present invention.

Referring to FIG. 4, a side elevational view of assembly 56 is illustrated. Greater mechanical detail now observable includes a cam 78 part of lever 74, which engages a lever 79. Lever 79 is pivotally movable with a curved push lever 80 which abutably engages a plunger 81 to operate a priming pump to be described. Generally enrichment fuel enters assembly 56 through a conduit 72 and leaves through a conduit 82.

Figure 5:
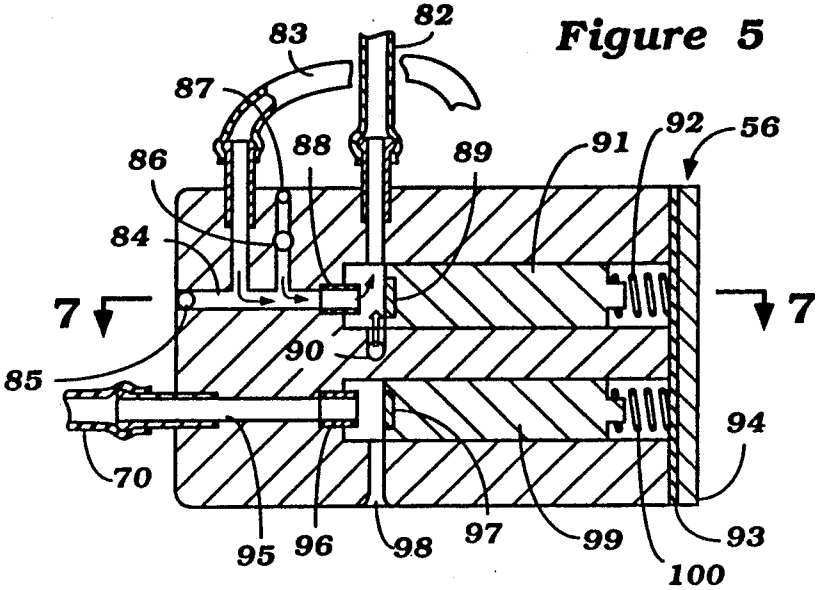
FIG. 5 is a cross sectional view taken along the line 5—5 of FIG. 4.
Figure 3:
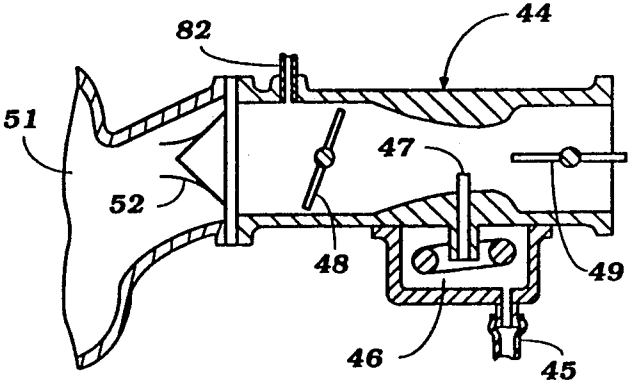
FIG. 3 is a cross sectional view of a carburetor assembly and intake manifold.

Referring to FIG. 5, a cross sectional detail about line 5—5 of FIG. 4 is illustrated. A primed fuel inlet line 83 is curvingly attached to assembly 56. Inlet line 83 communicates with a drilled passage 84 enclosed by a ball 85. Communicating with passage 84 is a check valve discharge port 86. Adjacent check valve discharge port 86 is a ball 87. Also communicating with passage 84 is a valve including a valve seat 88 and an elastomeric valve head 89 adjacent an air inlet passage 90. Elastomeric valve head 89 is situated at the end of an enrichment fuel valve 91. The other end of enrichment fuel valve 91 is urgingly engaged by a coil spring 92 against a seal 93 and cover plate 94. Adjacent valve seat 88, is the enrichment fuel line 82 which was seen extending away from assembly 56 in FIG. 4. Referring to FIG. 3, enrichment fuel from line 82 is introduced upstream of intake manifold 51. Thus, approximately half of FIG. 5 involves the valving of the enrichment fuel.

The other half of FIG. 5 includes vent line 70 as was previously observed in FIG. 4. Vent line 70 opens into a passage 95 extending through to a valve assembly including a valve seat 96, an opposing elastomeric valve head 97, situated adjacent an air passage 98. Elastomeric valve head 97 is mounted on a vent valve 99 which is in urging contact with a coil spring 100 which, in turn, counteringly urges seal 93 against cover plate 94. Thus, the other half of FIG. 5 is described as the vent valve for enrichment fuel tank 67 of FIG. 2.

Figure 6:
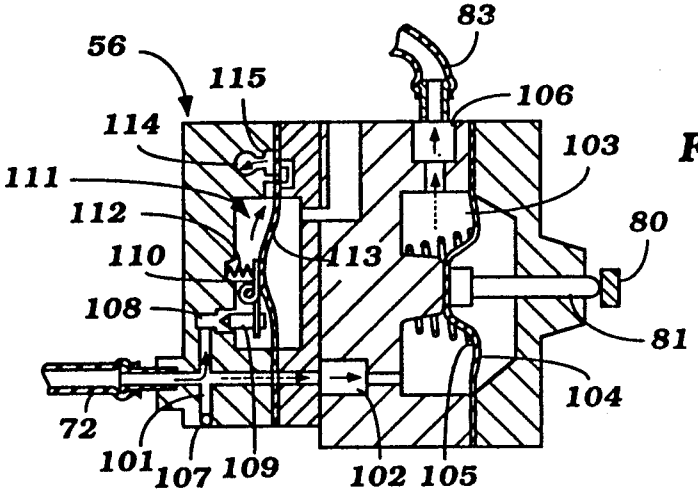
FIG. 6 is a cross sectional view taken along the line 6—6 of FIG. 4.

Referring to FIG. 6, a cross section taken at the line 6—6 of FIG. 4 is illustrated. FIG. 6 generally illustrates the details of both the primer pump and the flow means for the enrichment fuel taken from enrichment fuel tank 67 and supplied to valve 91 of FIG. 5. Enrichment fuel line 72 from enrichment fuel tank 67 is shown. Enrichment fuel line 72 opens into a passage 101 within a fuel adjuster housing. Fuel adjuster housing abuts a primer pump housing. Within fuel adjuster housing, passage 101 extends into the input of a check valve 102 situated within the primer pump housing. The output of check valve 102 extends into a chamber 103, which is partially defined by a diaphragm 104. A conically shaped spring 105 urgingly engages diaphragm 104 away from the inner wall of chamber 103. To the right of diaphragm 104 plunger 81, previously shown in FIGS. 1 and 4, extends through the primer pump housing. Push lever 80, as previously shown in FIG. 4, is also visible. Chamber 103 is shown in fluid communication with a check valve 106. The output of check valve 106 is in fluid communication with enrichment fuel input line 83 to the enrichment fuel valve 91 previously shown in FIG. 5.

Referring again to passage 101 of FIG. 6, passage 101 terminates at one end in a ball 107. Passage 101 also extends away from ball 107, terminating in an inlet port 108. A needle valve 109 partially covers inlet port 108, and is attached to a lever 110, which operates within a fuel adjuster chamber 111. Lever 110 is pivotally attached to a point within chamber 111 within the fuel adjuster housing, and is urged away from the inner wall of chamber 111 at one end by a spring 112. Fuel adjuster chamber 111 is partially defined by a diaphragm 113. Enrichment fuel adjuster chamber 111 is in communication with a port 114 through a check valve 115. FIG. 6 generally describes two flow paths for the enrichment fuel, namely, a primer path through a primer pump housing and a flow path through the enrichment fuel pressure adjuster housing.

Figure 7:
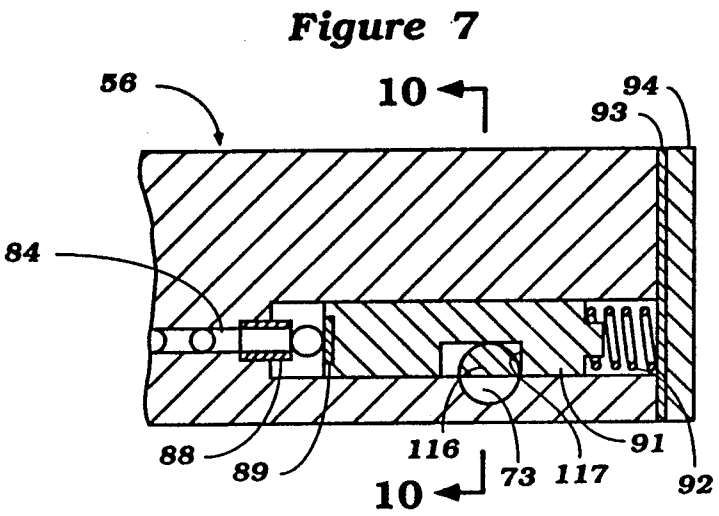
FIG. 7 is a cross sectional view taken along the line 7—7 of FIG. 5.

Referring to FIG. 7, a detail taken along line 7—7 of FIG. 5 is illustrated. This view gives a greater detail on how valve 91 is actuated. In addition to the detail seen in FIG. 5, FIG. 7 shows the valve shaft 73 having an enrichment fuel valve engaging member 116 within and engaging a cutaway portion 117 of enrichment fuel valve 91.

Figure 9:
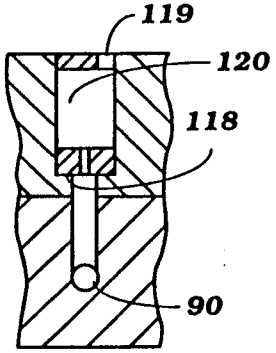
FIG. 9 is a cross sectional view taken along the line 9—9 of FIG. 8.

Referring to FIG. 9, an air jet 118 is shown with respect to line 9—9 of FIG. 8. An inlet passage 119 leads into one portion of the main body of a gasoline pot 120. Gasoline pot 120 is in communication with air jet 118, the designation for the structure of FIG. 9 which appeared in cross section in FIG. 8. Air jet 118 is in communication with a port 90, which was previously shown in FIG. 5.

Figure 10:
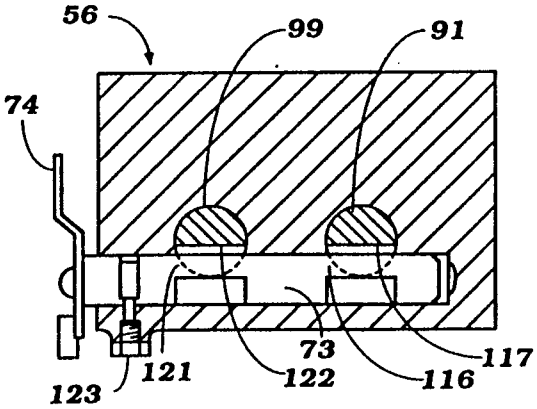
FIG. 10 is a cross sectional view taken along the line 10—10 of FIG. 7.

Referring to FIG. 10, a cross sectional detail along a line 10—10 of FIG. 7 illustrates the operation of enrichment fuel valve 91 and vent valve 99. In addition to the detail already discussed for enrichment fuel valve 91, vent valve 99 contains a vent valve engaging member 121 and a cutaway portion 122. A retainer screw 123 holds valve shaft 73 in place.

Figure 11:
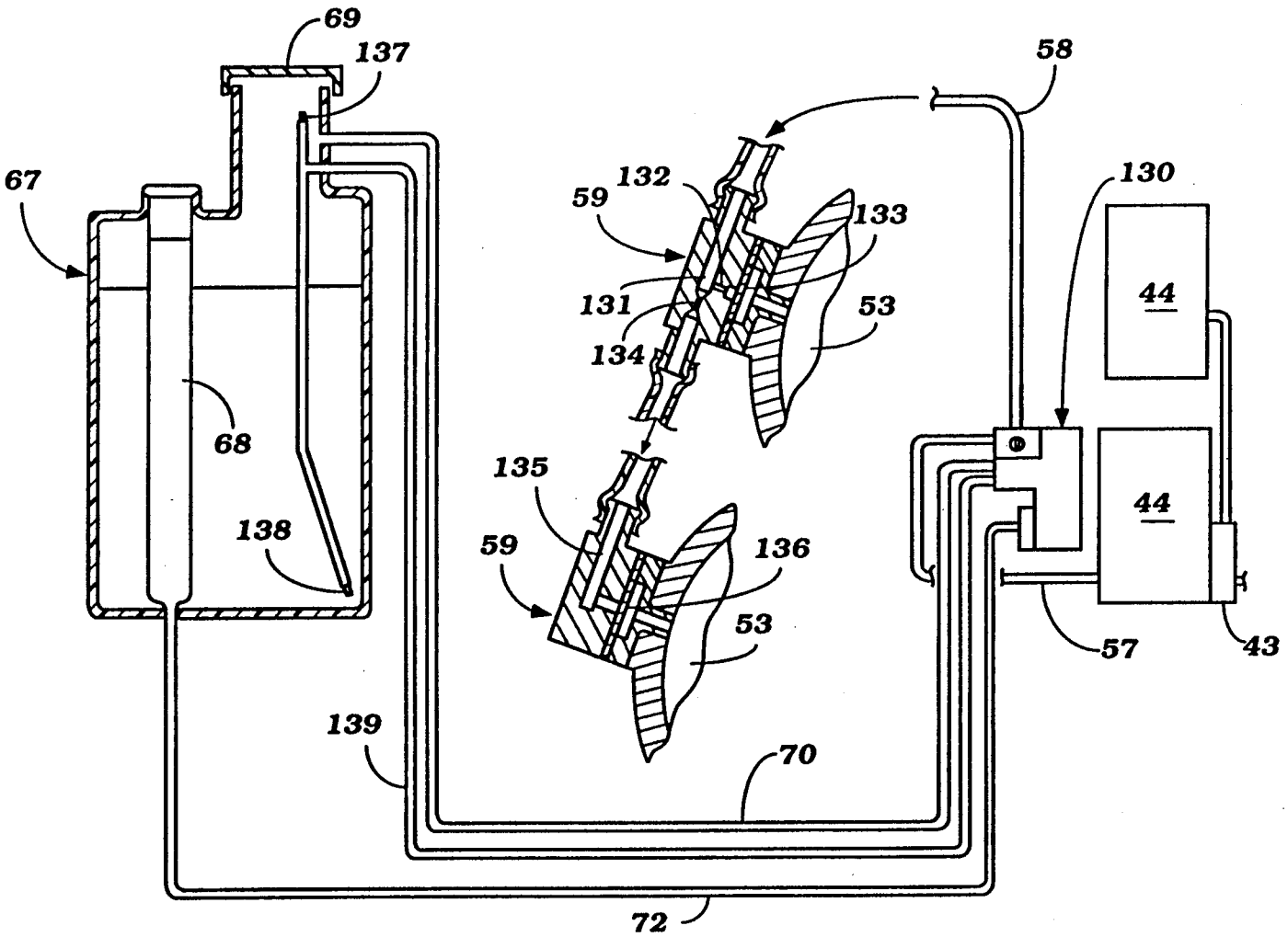
FIG. 11 is a schematic of another embodiment of the enrichment fuel system similar to that shown in FIG. 2.

Referring to FIG. 11, a schematic view of an alternate embodiment of the present invention is shown. Only structures differing significantly from those of the previous figures will be discussed. In FIG. 11 a slightly different assembly is illustrated designated by number 130. From assembly 130, the main fuel passage 58 approaches a different environment than shown previously in FIG. 2. From main fuel passage 58, the fuel enters a first fuel pipe 131 and then continues towards the scavenge ports 53 of the combustion chamber (not wholly shown) through an orifice 132. A check valve 133 connects orifice 132 to scavenger port 53. An orifice 134 connects fuel pot 131 to a fuel pot 135. A check valve 136 lies between fuel pot 135 and scavenging port 53.

In FIG. 11, enrichment fuel tank 67 contains an air jet 137 and a fuel jet 138 which feed an enrichment fuel air-mixed line 139 into assembly 130. Thus FIG. 11 illustrates that enrichment fuel may be mixed with air at a point within the enrichment fuel tank 67.

Referring to FIG. 12, again only those structures which differ from those of the previous figures will be discussed. Air fuel mix line 139 enters assembly 130 at a point adjacent enrichment fuel vent line 70.

Figure 13:
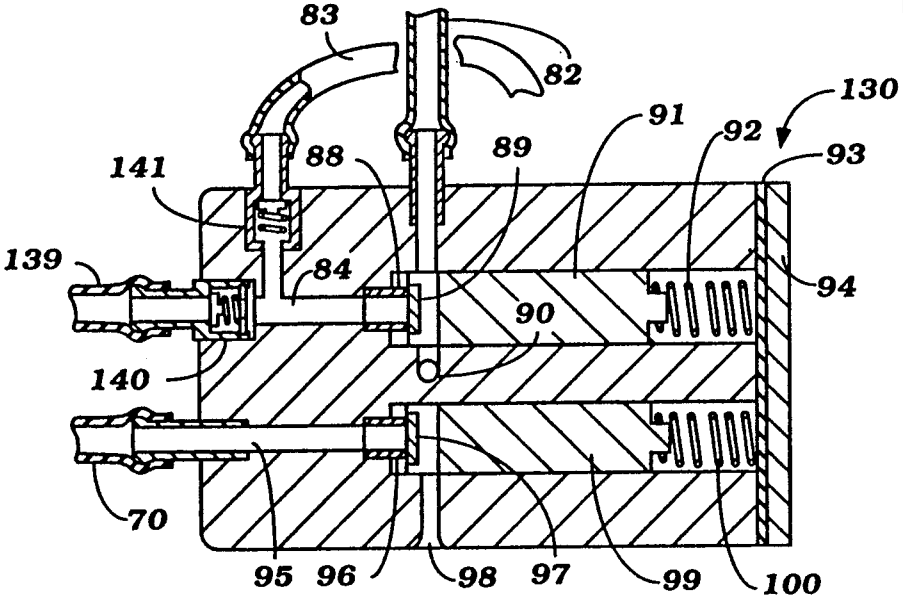
FIG. 13 is a cross sectional view taken along the line 13—13 of FIG. 12.

Referring to FIG. 13, and again referring only to those structures are unlike those of the previous figures, air fuel mix line 139 is connected to the input of a poppet valve 140. Enrichment fuel passage 83 leads to the input of a poppet valve 141 and the outputs of both poppet valves 140 and 141 are in fluid communication with passage 84. Other structures of FIG. 13 are identical to those of FIG. 5 with the exception of the absence of ball 85 and ball 87 and discharge port 86, both of these structures of which were associated with FIG. 5.

Figure 12:
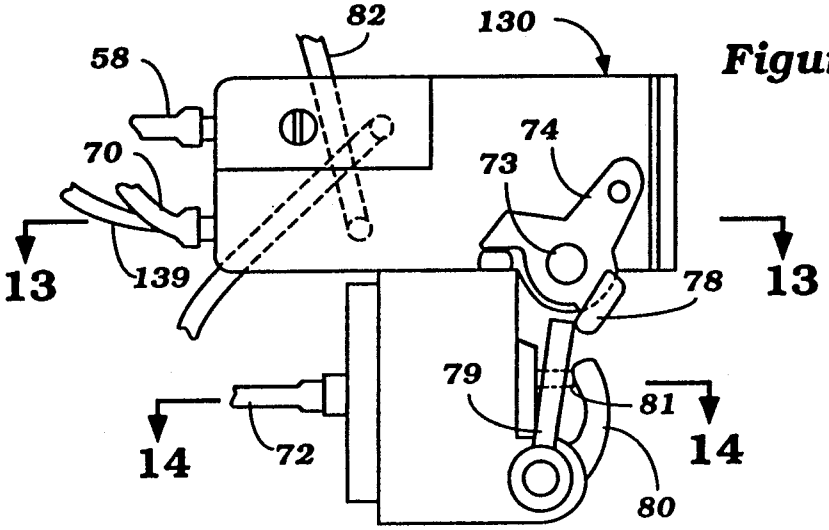
FIG. 12 is an elevational view of the enrichment fuel actuating assembly of the embodiment of FIG. 11.
Figure 14:
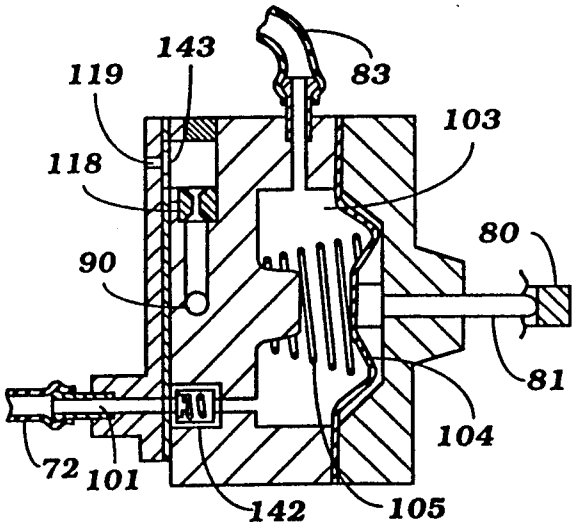
FIG. 14 is a cross sectional view taken along the line 14—14 of FIG. 12.

Referring to FIG. 14, a cross sectional view about line 14—14 of FIG. 12 is illustrated. Note that FIG. 14 generally illustrates the primer pump structure of FIG. 6, but does not illustrate the enrichment fuel pressure equalization structures contained within the pressure adjuster housing of FIG. 6. Referring to FIG. 14, enrichment fuel line 72, as shown in FIG. 11, is in communication with passage 101 which is in further communication with the input of a poppet valve 142. Poppet valve 142 has an output in fluid communication with chamber 103.

Air jet 118 previously shown in FIGS. 8 and 9 of the previous embodiment is now located in the primer pump housing and contains a check valve 143. The remaining structures of FIG. 14 regarding the primer pump are virtually identical with those of FIGS. 6 and 9 with the exception of the absence of a check valve 106 which was shown in FIG. 6.

The embodiments of FIGS. 11-14 utilize the air fuel mix passage 139 for its flowing supply of enrichment fuel while using the wholly liquid supply of enrichment fuel during the priming operation through passage 83.

Referring to FIG. 1, the operation of the outboard engine 23 utilizing the present invention is as follows: Upon cold startup, the lever 77 is brought to the downward position. When this is accomplished, the fuel valve 91 and the vent equalization valve 99 of FIG. 5 are opened. Simultaneous to the opening of valves 91 and 99, plunger 81 of FIG. 6 presses against diaphragm 104, causing the pressure in chamber 103 to increase, which forces the enrichment fuel through check valve 106 of FIG. 6 and into the passage 83. Enrichment fuel moving along passage 83 enters passageway 84 of FIG. 5 and flows across valve seat 88 and through passage 82. Enrichment fuel from passage 82 enters the carburetor 44 of FIG. 3. At this point in time, engine 23 of outboard motor 21 is now amenable to cold starting, utilizing its enrichment fuel in addition to its main fuel supply. Once engine 23 has been running for a time, the movement of lever 77 of FIG. 1 back to the upward position will cause valves 91 and 99 to close. The closure of valve 91 will eliminate the flow of enrichment fuel to carburetor 44. The closure of vent valve 99 will seal off the enrichment fuel tank 67. Valve 99 is for the purpose of allowing enrichment fuel from enrichment fuel tank 67 to become displaced by air as it is drained from tank 67. Since most outboard motors 21 are, at one time or another, stowed or tilted, the closure of vent valve 99 will prevent any of the enrichment fuel from leaking through its vent line 70 of FIGS. 2 or 11. In addition, the return of lever 77 to its normal position causes engine 23 of outboard motor 21 to become wholly dependent upon fuel from the main fuel tank 37.

The foregoing disclosure and description of the invention are illustrative and explanatory thereof, and various changes in the configuration of the disclosed fuel supply means, the details concerning the introduction of the enrichment fuel to the engine, the relative characteristics of the fuels, and the manner of implementation of enrichment fuel availability, as well as the materials of construction, location of the various components, along with any changes of the illustrated construction may be made without departing from the spirit and scope of the invention.

What is claimed is:

1. The enrichment system for an internal combustion engine comprising: means for supplying primed enrichment fuel to said engine, means for supplying flowing enrichment fuel to said engine, means for simultaneously actuating both of said means for supplying, said means for supplying a primed enrichment fuel is an enrichment primer pump which further comprises: a housing defining a pump chamber, a first check valve having an inlet forming said inlet of said enrichment primer pump, and an outlet in fluid communication with said pump chamber, a second check valve having an inlet in fluid communication with said pump chamber and an outlet forming said outlet of said enrichment primer pump; a spring within said pump chamber in urging contact between said housing and said diaphragm; a plunger extending through an aperture in said housing in touching contact with said diaphragm and opposing said urging engagement of said spring with said diaphragm; and, leverage means in contact with said plunger for urging said plunger in said diaphragm against said spring for actuating said enrichment primer pump.

2. The enrichment fuel system comprising: means for supplying primed enrichment fuel to said engine, means for supplying flowing enrichment fuel to said engine, means for simultaneously actuating both of said means for supplying, said means for supplying flowing enrichment fuel is a pressure adjuster and further comprises: an adjuster housing having a chamber, an inlet port in fluid communication with said chamber; and adjuster needle valve movably fittable within said inlet port; and adjuster lever supportingly connected at one end to said needle valve and pivotally supported by said adjuster housing and having a second end; an adjuster spring in urging contact with said second end of said adjuster lever and against said adjuster housing, for urging said needle valve to the closed position; an adjuster diaphragm partially defining said chamber of said adjuster housing, said diaphragm in urging contact with said second end of said adjuster lever in opposition to said adjuster spring; and, an adjuster check valve having an inlet in fluid communication with said chamber of said adjuster, and an outlet forming said outlet of said fuel pressure adjuster.

3. An enrichment fuel system for an internal combustion engine having a carburetor, comprising: an enrichment fuel source; an enrichment fuel flow regulator having an input connected to said enrichment fuel source and an output; a primer pump having an input connected to said enrichment fuel source, an actuator, and an output; an enrichment fuel valve having first input connected to said output of said flow regulator, a second input connected to said output of said primer pump, and an output connected to said carburetor of said internal combustion engine.

* * * * *